US006351968B1

(12) United States Patent
Habicht et al.

(10) Patent No.: US 6,351,968 B1
(45) Date of Patent: Mar. 5, 2002

(54) METHOD AND DEVICE FOR EVAPORATING LIQUID OXYGEN

(75) Inventors: Franz Habicht; Gerhard Pompl, both of München (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/601,217

(22) PCT Filed: Jan. 15, 1999

(86) PCT No.: PCT/EP99/00203

§ 371 Date: Jul. 28, 2000

§ 102(e) Date: Jul. 28, 2000

(87) PCT Pub. No.: WO99/39143

PCT Pub. Date: Aug. 5, 1999

(30) Foreign Application Priority Data

Jan. 30, 1998 (DE) ..... 198 03 583
Apr. 20, 1998 (EP) ..... 98107128

(51) Int. Cl.[7] ..... F25J 1/00
(52) U.S. Cl. ..... 62/643; 62/905
(58) Field of Search ..... 62/643, 903; 165/166

(56) References Cited

U.S. PATENT DOCUMENTS 2,650,482 A 9/1953 Lobo
2,664,719 A 1/1954 Rice et al.
2,688,238 A 9/1954 Schilling
4,606,745 A * 8/1986 Fujita ..... 62/903
5,071,458 A * 12/1991 Grenier et al. ..... 62/903
5,205,351 A * 4/1993 Muller et al. ..... 62/903
5,507,356 A * 4/1996 Roth et al. ..... 62/643

FOREIGN PATENT DOCUMENTS

EP 0341854 11/1989
GB 1171388 11/1969

* cited by examiner

*Primary Examiner*—Ronald Capossela
(74) *Attorney, Agent, or Firm*—Millen, White, Zelano & Branigan. P.C.

(57) ABSTRACT

The process and the apparatus serve for evaporating liquid oxygen. In the normal operation liquid oxygen is introduced into a main evaporator (3) and there partially evaporated, a first flushing stream (5) is removed in the liquid state from the main evaporator (3), the first flushing stream (5) is partially evaporated in an auxiliary evaporator (6) and a second flushing stream (7) is taken off in the liquid state from the auxiliary evaporator (6).

Figure 1:
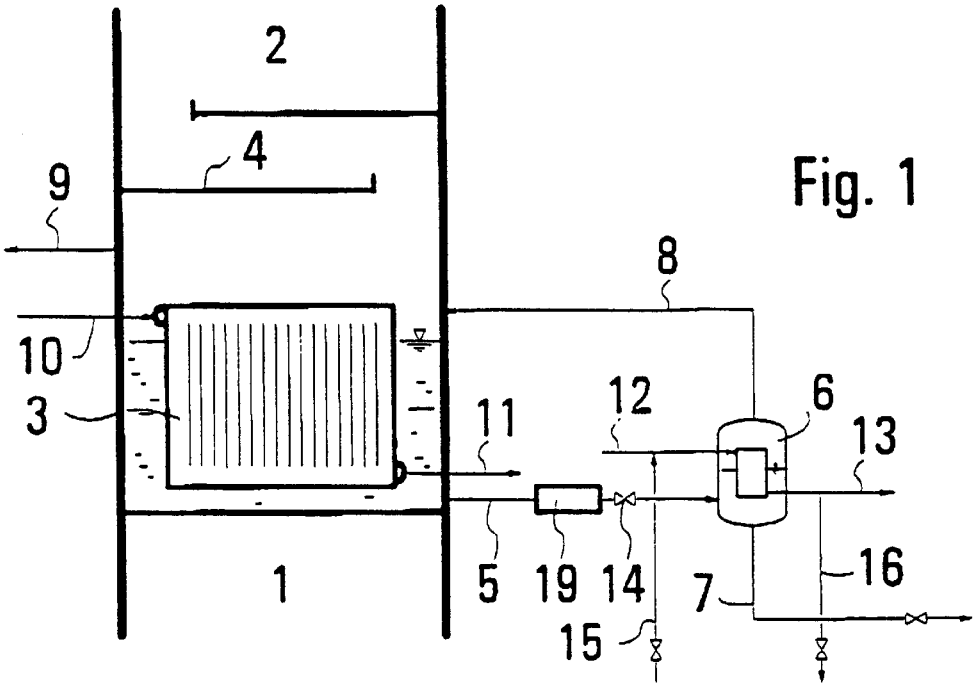

The normal operation is interrupted by a heating operation in which no liquid (5) is passed from the main evaporator (3) into the auxiliary evaporator (6) and the auxiliary evaporator (6) is brought to a temperature which is markedly higher than its temperature in the normal operation.

15 Claims, 1 Drawing Sheet

METHOD AND DEVICE FOR EVAPORATING LIQUID OXYGEN

The invention relates to a process for evaporating liquid oxygen and to its use in a process for producing oxygen by low-temperature fractionation of air.

Oxygen, in the present application, is taken to mean any mixture which has an oxygen content elevated with respect to air, for example at least 70%, preferably at least 98%. (In this application, all percentages denote molar amounts, unless explicitly stated otherwise.) This includes, in particular, impure oxygen, and also industrial-grade pure oxygen and high-purity oxygen having a purity of 99.99% or above. For a host of applications, it is necessary to convert liquid oxygen present, before its use, into the gas form by evaporating it in a main evaporator by indirect heat exchange with a heat carrier.

An evaporation of this type occurs in particular in the production of gaseous oxygen by low-temperature rectification, in which the oxygen product occurs in the liquid state at the bottom of a rectification column, since it is less volatile than nitrogen and argon. To obtain the product in the gas form and to generate ascending vapour for the rectification column, the oxygen occurring in the liquid state must likewise be evaporated in a main evaporator. The most widespread here is the classic Linde double-column process in which the main evaporator is disposed in the bottom of a low-pressure column and is operated by condensing nitrogen from the top of the pressure column (see Hausen/Linde, Tieftemperaturtechnik [low-temperature engineering], 2nd Edition, Section 4.1.2 on page 284). The main evaporator in this case is operated as a condenser-evaporator and is frequently termed main condenser. It is also implemented by one or more heat-exchange blocks which are operated as circulating or falling-film evaporators.

The invention also relates to other double-column processes in which the main evaporator is operated with air, for example, and also processes having three or more columns for nitrogen-oxygen separation. Downstream of the rectification column or columns for the nitrogen-oxygen separation, apparatuses for producing other air components, in particular noble gases, can be connected, for example for argon production.

If liquid oxygen is evaporated completely or essentially completely, less volatile impurities, such as $CO_2$ or $N_2O$, for example, can accummulate in the evaporator, even if these impurities are only present in very low concentrations in the oxygen (or the air to be fractionated) to be evaporated. (However, the acetylene which was feared earlier is no longer a problem in air-fractionation plants having preliminary purification by adsorption). Some of these less volatile substances, $CO_2$ and $N_2O$, for example, can precipitate as solids and must be removed from time to time so that blockage of the heat-exchange passages in the main evaporator is avoided. To remove these solids which have separated out, the entire plant must be shut down. In a large air-fractionation plant, this can mean a works shutdown of from two to five days, for example.

To reduce the accummulation of less volatile components, it is customary to take off continuously, or from time to time, some liquid in the form of a purging stream from the main evaporator and to discard this stream. Together with this purging volume, the less volatile impurities accummulated in the oxygen which has remained in the liquid state are also removed, so that their concentration can be limited in the main evaporator. In an air-fractionation plant having preliminary purification by adsorption, the purging volume is customarily from 0.02 to 0.04% of the total amount of liquid oxygen introduced into the evaporator. Since, for air purification upstream of the rectification, molecular sieve absorbers have been used instead of the reversible heat exchangers (Revex) or regenerators previously used, the problems due to the accummulation of combustible less volatile components in an oxygen evaporator of this type (main evaporator) have decreased to the extent that a purging stream of this type is sufficient to prevent hazardous concentrations of hydrocarbons without requiring additional measures (see Hausen/Linde, Tieftemperaturtechnik [low-temperature engineering], 2nd Edition, Section 4.5.1.5 on pages 312 and 313).

The object underlying the invention is to increase the availability of a main evaporator for evaporating liquid oxygen and, in particular, to prevent interruptions to operations as far as possible.

This object is achieved by the features of Patent Claim 1. In this, the (first) purging stream which is taken off from the main evaporator is passed into an auxiliary evaporator which is disposed separately from the main evaporator. In this auxiliary evaporator a large part of the first purging stream is evaporated and can thus be produced as oxygen product or as intermediate oxygen product. In turn, a second purging stream is taken off from the auxiliary evaporator and discarded. (In the special case that krypton and/or xenon are to be produced from the liquid oxygen, further work-up is necessary.) Whereas the first purging stream is continuously passed from the main evaporator to the auxiliary evaporator, the second purging stream can be taken off continuously or batchwise.

In the invention, a relatively large amount of liquid can be taken off from the main evaporator as first purging stream, so that all of the less volatile components can be ejected and their concentration can be kept low in the main evaporator. In particular, no solids deposits occur either in the main evaporator. However, this large volume of purging liquid is not completely lost, since some of the first purging stream is evaporated in the auxiliary evaporator and taken off in the gas form. From the auxiliary evaporator, merely a customary purging volume is taken off as second purging stream, for example from 0.02 to 0.5%, preferably from 0.02 to 0.2%, of the amount of liquid oxygen introduced into the main evaporator. (In the case of batchwise taking off of the second purging stream, the percentages refer to the time average.) The remainder of the first purging stream is evaporated in the auxiliary evaporator and can be utilized as gaseous oxygen product.

Using the invention it is possible to purge the main evaporator so intensively that the content of less volatile components which could lead to solids deposits is kept extremely low. The less volatile components are passed completely to the auxiliary evaporator and there removed via the second purging stream and the heating operation performed from time to time.

Solids deposits can therefore occur only in the auxiliary evaporator, but not in the main evaporator. However, the auxiliary evaporator can be freed from solids considerably more simply than the main evaporator by heating. For this purpose, the normal operation is occasionally interrupted by a heating operation, in the heating operation the auxiliary evaporator being separated from the main evaporator with no liquid being passed from the main evaporator into the auxiliary evaporator. Simultaneously, the auxiliary evaporator is brought to a temperature which is markedly higher than its temperature in the normal operation, for example by at least 20 K, preferably from 20 to 50 K. The operation of the main evaporator and the plant in which it is installed does not need to be interrupted in this process. Due to the intensified purging of the main evaporator, this no longer needs to be heated to remove solids.

It is expedient if the amount of the first purging stream which is taken off from the main evaporator in the normal operation is at least 1%, preferably at least 3%, and/or at most 10%, preferably at most 5%, of the amount of liquid oxygen introduced into the main evaporator.

The invention further relates to the use of the process according to Claim 1 or 2 in a process for the low-temperature fractionation of air according to patent Claim 3 and, in a corresponding apparatus according to Patent Claim 6, in particular air-fractionation processes and plants having air prepurification by adsorption, for example on a molecular sieve. Processes and plants of this type serve for the production of oxygen, nitrogen and/or other gases present in atmospheric air.

In addition, the invention relates to an apparatus for evaporating liquid oxygen according to Patent Claims 4 and 5.

Figure 2:
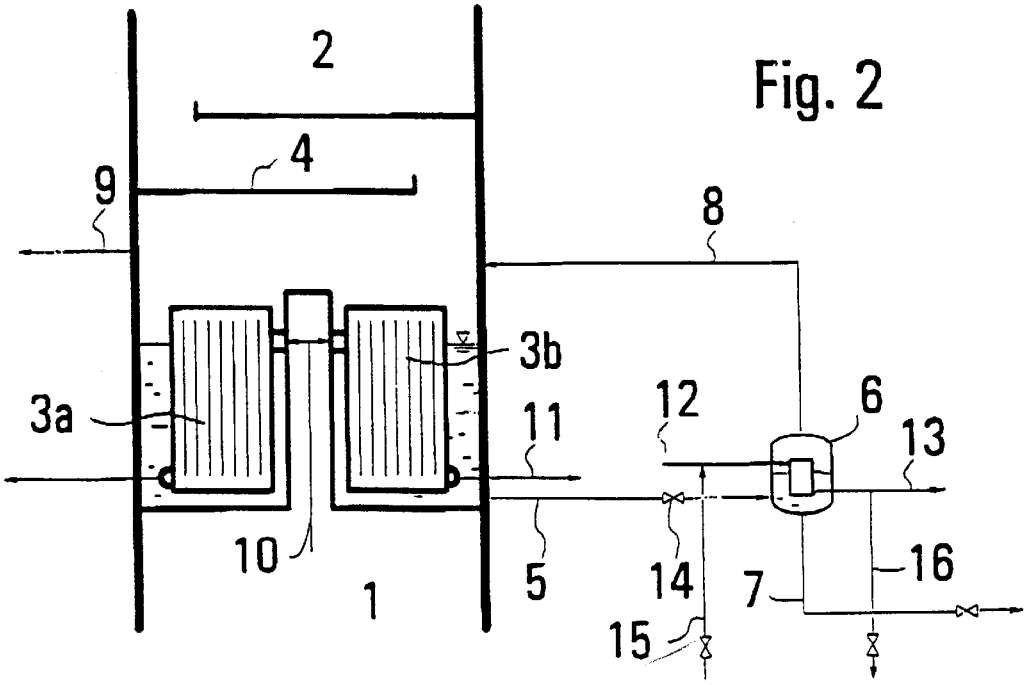

The invention and other details of the invention are explained in more detail below with reference to exemplary embodiments shown in the drawings. In the drawings:

FIG. 1 shows a first exemplary embodiment having a main evaporator consisting of a block and FIG. 2 shows a second exemplary embodiment having a main evaporator consisting of a plurality of blocks.

FIG. 1 shows a section of a double column for the low-temperature fractionation of air, namely the upper part of pressure column 1 and the lower section of the low-pressure column 2. A main evaporator 3 serves to evaporate liquid oxygen which flows off from the lowest mass transfer section of the low-pressure column 2. (The lowest mass transfer section is shown as plate 4 in the drawing, but this could also be an arranged packing.) Gaseous oxygen product is taken off from the low-pressure column via line 9.

The main evaporator can—as shown in FIG. 1—be disposed within the double column, in particular in the bottom of the low-pressure column. Alternatively, it can be implemented as a separate component outside the double column or be integrated into another component separate from the double column, for example into a methane ejection column, as shown in DE 4332870 A1 or DE 2055099 A. Via a line 5 disposed in the lower region of the main evaporator 3, a first purging stream is continuously taken off and introduced into an auxiliary evaporator 6. From the lower area of the auxiliary evaporator 6, a second purging stream 7 is taken off continuously or batchwise, while evaporated oxygen 8 is returned to the low-pressure column. Alternatively thereto, the vapour 8 can be passed from the low-pressure column into the oxygen product line 9 or into another apparatus, for example into the lower area of a methane ejection column according to DE 4332870 A1 or DE 2055099 A.

The heat carrier 10 used for the indirect heating of the main evaporator is nitrogen from the top of the pressure column 1. The nitrogen 11 condensed in the main evaporator is used as reflux to both columns. The auxiliary evaporator 6 is heated in the normal operation either likewise with nitrogen from the pressure column or with air as heat carrier 12. The condensed heat carrier is taken off via line 13 and fed into one or more of the rectification columns.

At certain time intervals of, for example, from three to twelve months, preferably about six months, there is a switchover from the normal operation to the heating operation by closing valve 14 in the first purging line 5. The feed of the heat carrier 12 is also closed. Instead, hot air at about 300 K is conducted via line 15 into the liquefaction compartment of the auxiliary evaporator 6 and removed again via line 16. A heating phase comprises shutting off, emptying, heating, recooling and startup and lasts, for example, from 10 to 24 hours, preferably about 20 hours.

It is advantageous, but in the context of the invention not absolutely necessary, if the first purging stream 5, prior to its introduction into the auxiliary evaporator 6, is passed through a device 19 for removing less volatile components, for example by adsorption.

The exemplary embodiment of FIG. 2 differs from FIG. 1 by the main evaporator being formed by a multiplicity of blocks 3*a,* 3*b*. The blocks 3*a,* 3*b* are disposed, for example, concentrically about a central tube which serves as the feed 10 of gaseous nitrogen from the pressure column 1. Obviously, this exemplary embodiment can also be equipped with a device for removing less volatile components (19 in FIG. 1).

What is claimed is:

1. A process for evaporating liquid oxygen comprising during normal operation, the steps of:

providing a source of liquid oxygen;

partially evaporating said liquid oxygen in contact with a main evaporator (3) to form vapor (9);

removing a portion of said liquid oxygen from said source of liquid oxygen, as a first purge stream (5);

passing said first purge stream (5) to an auxiliary evaporator (6);

partially evaporating the first purge stream (5) in said auxiliary evaporator (6) and removing from said auxiliary evaporator (6) a second purge stream in the liquid state, and interrupting said normal operation by a heating operation, said heating operation comprising:

stopping the flow of the first purge stream (5) from the main evaporator (3) into the auxiliary evaporator (6); and increasing the temperature of the auxiliary evaporator (6) to a temperature higher than the temperature in the auxiliary evaporator during normal operation.

2. A process according to claim 1, wherein the amount of the first purge stream (5) is at least 1%, and at most 10% of the amount of liquid oxygen introduced into the main evaporator (3).

3. A process according to claim 2, wherein the amount of said first flushing steam is 3–5% of the amount of the liquid oxygen introduced into the main evaporator (3).

4. A process according to claim 1 further comprising producing oxygen by low-temperature fractionation of air in a rectification system which has a high pressure column (1) and a low-pressure column (2) for evaporating liquid oxygen from the low-pressure column (2), further comprising introducing at least some of the vapor (8) generated in the auxiliary evaporator (6) into the low-pressure column (2), or taking the vapor off as gaseous oxygen product, or both.

5. A process according to claim 4, wherein at least some of the vapor (8) generated in the main evaporator (3) and in the auxiliary evaporator (6) is introduced into the low pressure column.

6. A process according to claim 1, wherein in the heating operation, the auxiliary evaporator (6) is brought to a temperature at least 20° K higher than its temperature in normal operation.

7. An apparatus for evaporating liquid oxygen comprising:

a main evaporator (3), an auxiliary evaporator (6), a source of liquid oxygen, introduction means for introducing said liquid oxygen into the main evaporator, a first purge line (5) connected between the main evaporator (3) and the auxiliary evaporator (6) capable of taking off a first liquid purge stream from the main evaporator (3) and capable of introducing the first liquid purge stream into the auxiliary evaporator (6), a second purge line (7) connected to the auxiliary evaporator (6) and capable of taking off a second liquid purge stream from the auxiliary evaporator (6), a gas product line (8) connected to the auxiliary evaporator (6) and capable of taking off vapor from the auxiliary evaporator and a heating apparatus (15, 16) capable of increasing the temperature of the auxiliary evaporator to a temperature higher than the temperature in the auxiliary evaporator during normal operation, said heating apparatus being optionally connected to the auxiliary evaporator (6).

8. An apparatus according to claim 7 further comprising a control device capable of setting the amount of the first purge stream (5) in the normal operation to at least 1%, and at most 10%, of the amount of liquid oxygen introduced into the main evaporator (3).

9. An apparatus according to claim 7 further comprising an apparatus for producing oxygen by low-temperature fractionation of air , the apparatus for producing oxygen comprising:

a rectification system which has a high pressure column (1) and a low-pressure column (2), wherein the apparatus capable of introducing liquid oxygen into the main evaporator (3) is connected to the low-pressure column (2)

and wherein the oxygen producing apparatus further comprises an oxygen product line (9, 8) for taking off gaseous oxygen product from the main evaporator (3), or from the auxiliary evaporator (6), or both.

10. An apparatus according to claim 9 further comprising a gas line (8) capable of taking off vapor from the auxiliary evaporator (6) and which is connected to the low-pressure column (2) or to the oxygen product line (9) connected to the low-pressure column.

11. An apparatus according to claim 10, wherein said gas product line (8) is connected to the low pressure column (2).

12. An apparatus according to claim 10, wherein said gas product line (8) is connected to said product line (9) connected to the low pressure column.

13. An apparatus according to claim 9, wherein the amount of said first flushing steam is 3–5% of the amount of the liquid oxygen introduced into the main evaporator (3).

14. An apparatus according to claim 9, comprising an oxygen product line (9) for withdrawing gaseous oxygen product from the main evaporator (3).

15. An apparatus according to claim 9, comprising an oxygen product line (8) for withdrawing gaseous oxygen product from the auxiliary evaporator (6).

* * * * *